United States Patent [19]

Zahn et al.

[11] Patent Number: 4,581,820

[45] Date of Patent: Apr. 15, 1986

[54] METHOD OF MAKING AN ELECTRICAL CONNECTOR SYSTEM AND A TERMINAL THEREFORE

[75] Inventors: Irwin Zahn, New York, N.Y.; John N. Kendall, Jackson, Miss.

[73] Assignee: General Staple Company, Inc., Woodside, N.Y.

[21] Appl. No.: 500,659

[22] Filed: Jun. 3, 1983

[51] Int. Cl.[4] ..... H01R 43/00; H01R 4/00

[52] U.S. Cl. ..... 29/855; 174/84 C; 339/99 R; 339/97 P

[58] Field of Search ..... 29/884, 885, 863, 857; 339/99 R, 98, 223 R, 276 R, 97 R, 97 P, 176 MF, 258 R, 198 G, 176 MP, 192; 336/192

[56] References Cited

U.S. PATENT DOCUMENTS

| | | | |
|---|---|---|---|
| 3,189,857 | 6/1965 | Jones | 336/192 X |
| 3,359,520 | 12/1967 | Foerster | 336/192 |
| 3,496,504 | 2/1970 | Daley | 339/223 X |
| 3,654,594 | 4/1972 | Sitzler | 339/223 R |
| 3,701,961 | 10/1972 | Folk | 336/192 |
| 3,760,339 | 9/1973 | Marshall | 339/276 R X |
| 4,084,878 | 4/1978 | Wahi | 339/99 R |
| 4,241,970 | 12/1980 | Rider, Jr. et al. | 339/99 R |
| 4,435,035 | 3/1984 | Berry et al. | 339/208 X |

FOREIGN PATENT DOCUMENTS

| | | |
|---|---|---|
| 888213 | 1/1962 | United Kingdom . |
| 960291 | 6/1964 | United Kingdom . |
| 1129233 | 10/1968 | United Kingdom . |
| 1211002 | 11/1970 | United Kingdom . |
| 1313993 | 4/1973 | United Kingdom . |
| 1385506 | 2/1975 | United Kingdom . |
| 1401383 | 7/1975 | United Kingdom . |
| 1407693 | 9/1975 | United Kingdom . |
| 2034538 | 6/1980 | United Kingdom . |

*Primary Examiner*—Howard N. Goldberg
*Assistant Examiner*—Carl J. Arbes
*Attorney, Agent, or Firm*—Perman & Green

[57] ABSTRACT

A system for coupling or connecting magnet wires to lead wires comprises terminals each having a portion upturned with an insulation displacement connector and each also having a portion with crimp connectors. The system also comprises a terminal holder with front and rear plates each having slots for supporting said connectors in a position to hold wires in an out-of-alignment orientation.

24 Claims, 7 Drawing Figures

METHOD OF MAKING AN ELECTRICAL CONNECTOR SYSTEM AND A TERMINAL THEREFORE

BACKGROUND OF THE INVENTION

This invention relates to a system for electrically coupling or connecting magnet wires to lead wires as in electrical devices. This system includes terminals or connectors fabricated from electrically conductive material such as a metal for coupling the wires. The system also includes a holder of an electrically insulating material such as plastic for supporting a plurality of such terminals in appropriate spaced relation, one from another. When the system is mounted in an electrical device, it provides a means and method for electrically connecting magnet wires with lead wires and, if necessary, miscellaneous other component wires, all of which may be of various sizes and types in any combination. One or more connecting systems may be used in an electrical device to suit the specific needs of the particular device.

One particularly useful application for such an electrical connector system is in transformers of ballasts for fluorescent lamps. Such transformers are generally made by assembling magnet wires in coils or windings around a magnetic circuit constructed of steel laminations. Copper or aluminum wires covered with an insulation of varnish or enamel normally constitute such magnet wires. The size and number of such magnet wire coil or windings will determine the characteristics of the transformer or other electrical component in which the connector system of the present invention is to be utilized.

The magnet wires to be utilized must be electrically connected to lead wires, usually of solid or multistranded conductors, covered normally with an extruded plastic insulation. These lead wires must be electrically connected at first ends to the magnet wires and then at their second ends to some other portion of an electrical circuit. Such other portion may be either internal to, or external of, the transformer or other electrical component to which they are coupled.

In prior art methods of manufacturing electrical connector systems for connecting magnet wires to lead wires, the ends of the magnet wire and the ends of the lead wires must be stripped of their insulation and then soldered together. As many as ten or twelve solder connections may be required in a typical transformer.

Soldering is a labor-intensive assembly process for joining wires and is dependent in large part upon the skill of the operator. Furthermore, aluminum soldering is particularly difficult. A poor electrical connection or cold joint will occur if the solder bath is not hot enough, if insufficient solder or flux is used, or if insufficient cooling is employed, and so forth. Further, fumes from the molten solder pollute the air while the heat of the bath itself generates a safety hazard, all to the potential injury of the employees carrying out this joining process or otherwise working in the vicinity.

Many such inductive electrical devices, transformers included, are normally dipped or vacuum impregnated in varnish, wax or other insulating compound as part of the manufacturing process before the completion of all electrical connections such as the lead wires to the magnet wires. This step, utilized by the industry in manufacturing, complicates the attachment process since it renders the subsequent interconnection difficult because of residues of impregnation material. This residues usually occur in the areas where the connections are to be made.

SUMMARY OF THE INVENTION

The present invention is directed to a system for electrically coupling magnet wires to lead wires in an electrical device. It is applicable to any magnetic wire material including copper, aluminum, etc. The system includes a plurality of electrically conductive terminals to which the ends of the wires are coupled. The system also includes an electrically insulative holder having retaining means such as slots for the reception of the terminals. Each terminal has at least two connectors. In one embodiment, each terminal is provided with a first end, upturned such as to about 90 degrees, formed with an insulation displacement connector while the other end of the terminal includes a crimp or barrel-type connectors.

The overall arrangement of connectors and slotted holder simplifies the connecting of the appropriate magnet wires to the appropriate lead wires and provides for a definite location and holding mechanism for connecting the wires for mechanical strength. The arrangement of the system also accommodates a wide range of wire sizes without compromising connection reliability. Furthermore, since soldering is totally eliminated, there is no need for either stripping the insulation from both the magnet wires and the lead wires or for removing any coating or buildup of impregnation material from the terminal before the connection of the lead wires to the terminals. The system is economical and efficient since it reduces the need for skilled operators in the connecting process while speeding up the wire joining process since it includes the use of crimping machines for interconnecting all wires. The safety of the operators is also enhanced since the elimination of soldering removes the inherent danger of injury to operators from the fumes and from the hot solder bath. The system also permits the lead wires to be connected to the terminal after the transformer or other electrical device is placed in its can.

These and other advantages of the present invention along with additional features thereof will become readily apparent upon a reading of the following detailed description of the preferred embodiment of the invention when read in association with the appended claims.

BRIEF DESCRIPTION OF THE DRAWINGS

This invention will now be described by reference to the following drawings and description wherein like elements have the same reference numbers throughout.

DETAILED DESCRIPTION OF THE INVENTION

The preferred embodiment of the instant invention is herein depicted as applied to an electrical device 10 shown for illustrative purposes as a fluorescent lighting ballast. Those skilled in the art will, however, readily recognize many other applications for the electrical connector system 12 of the instant invention.

Figure 1:
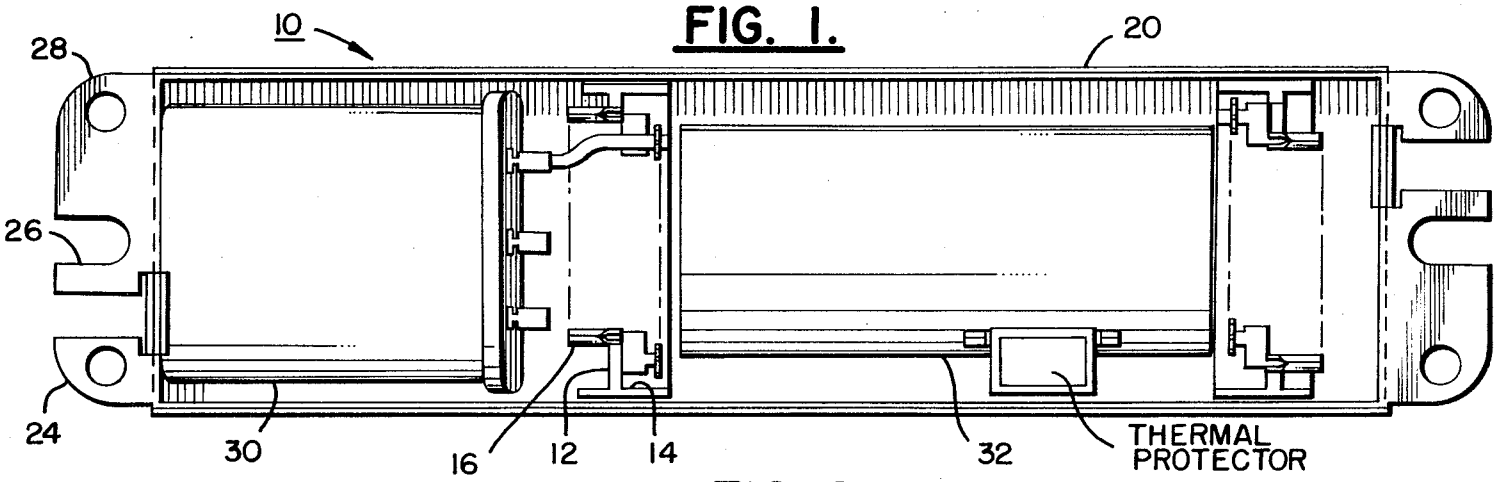
FIG. 1 is a top, plan view of an electrical device employing the connector system of the instant invention.
Figure 2:
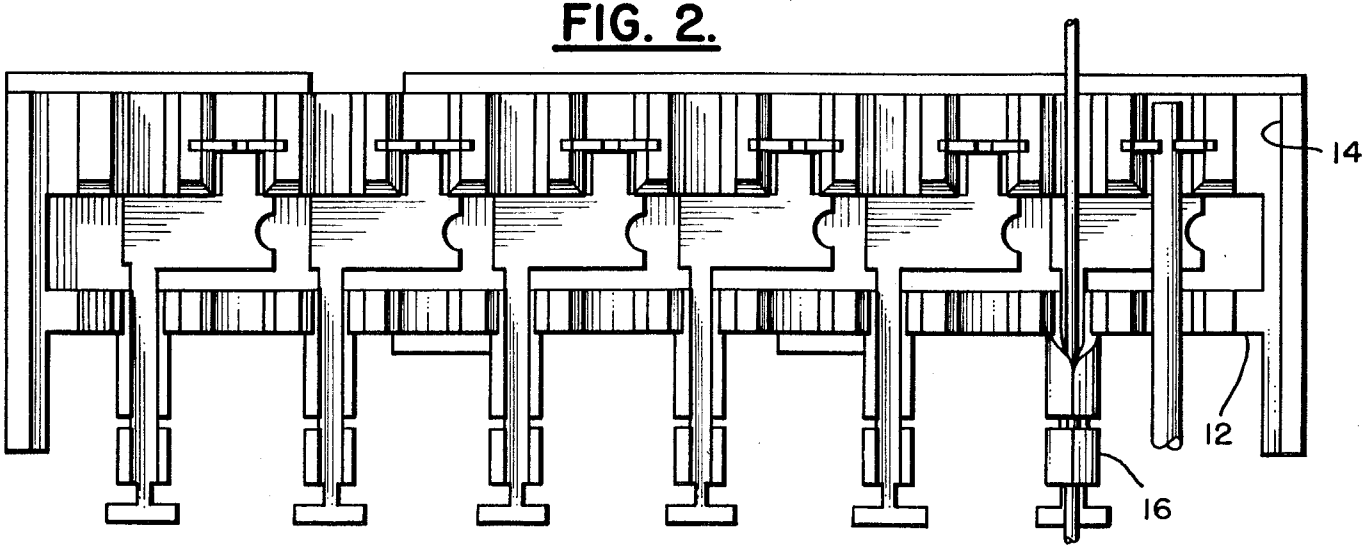
FIG. 2 is a top, plan view of the connector system including the housing and with one lead wire and one magnet wire in place.
Figure 3:
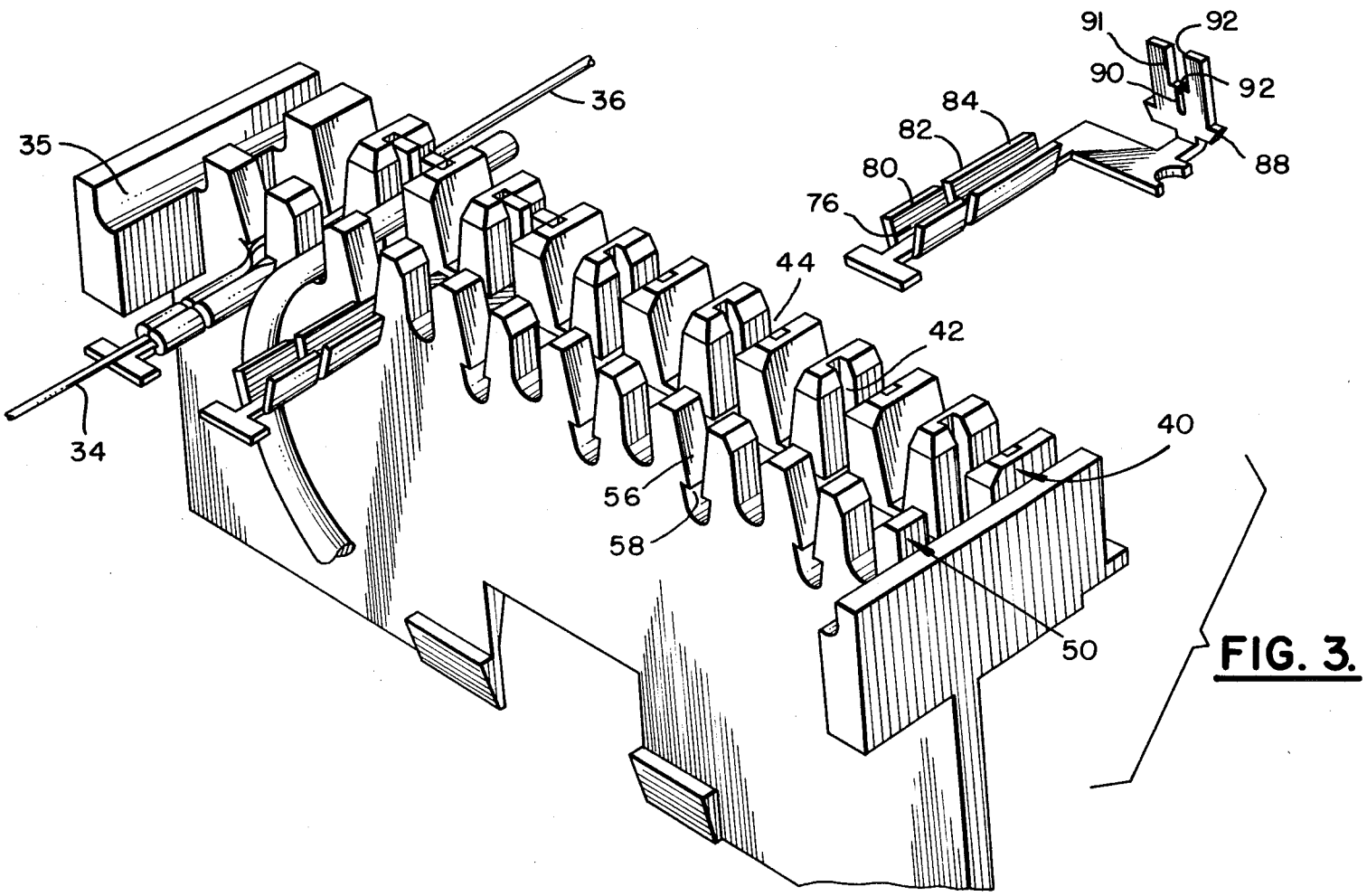
FIG. 3 is a top, front perspective view of the housing showing one connector coupled with a single magnet wire and a single lead wire, one connector without wires and one connector exploded from the housing.
Figure 4:
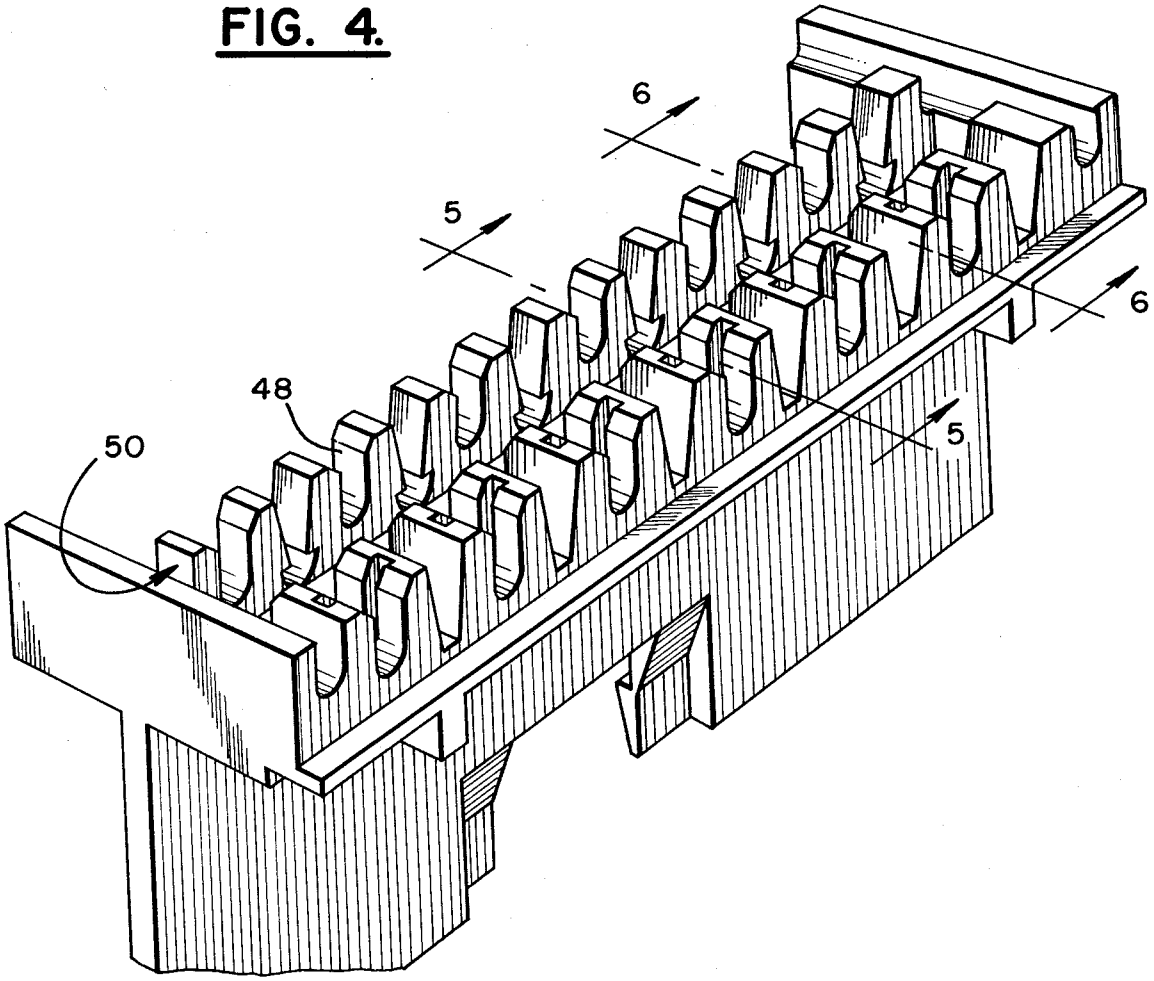
FIG. 4 is a top, rear perspective view of the housing.
Figure 5:
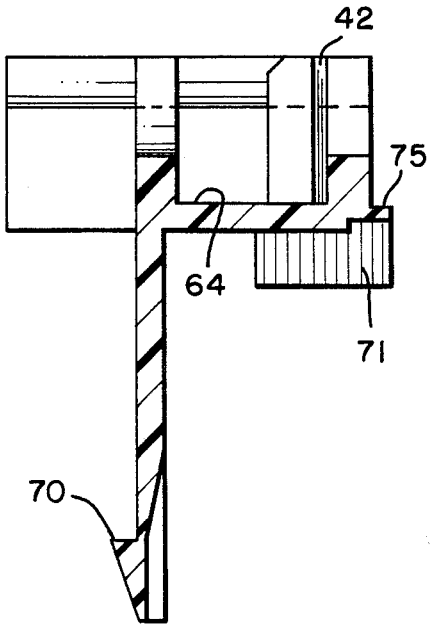
FIG. 5 is a sectional view taken along line 5—5 of FIG. 4.
Figure 6:
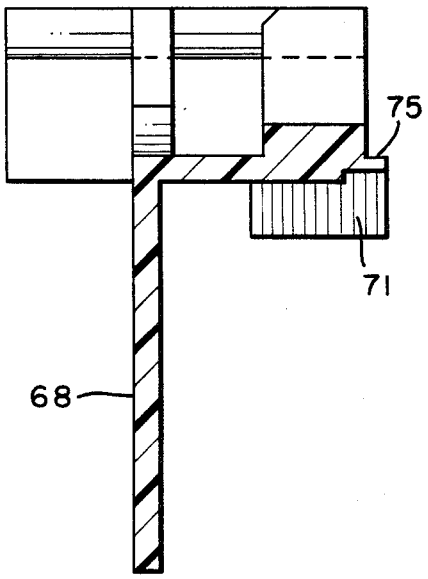
FIG. 6 is a sectional view taken along line 6—6 of FIG. 4.
Figure 7:
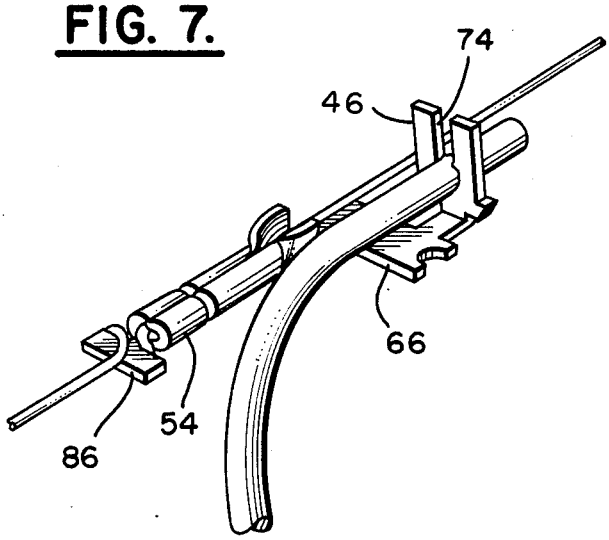
FIG. 7 is a perspective view of the an electrical terminal connector of the system with wires connected thereto.

The electrical connector system includes the terminal holder 14 and the terminals or connectors 16 positionable therein. With reference to the drawings and particularly to FIG. 1, there is shown the electrical device as a fluorescent lighting ballast. The device is supported in a housing 20 from which there extends flanges 24 with suitable mounting slots 26 and holes 28 for mounting the device in position for operation. Fixedly secured within the housing is a capacitor 30 and a transformer 32 to be electrically coupled together.

The transformer 32 is shown schematically in FIG. 1 and is generally fabricated from a plurality of laminations stacked on each side thereof with the laminations having ends and a central leg. Placed over the central leg are a plurality of windings or coils of magnet wires formed of a suitable number of turns of the magnet wire 34. The number of turns determines the electrical characteristic of the transformer. The windings are generally made individually and then slid over the central leg of the laminations. The enclosing housing or can is normally filled with an electrically insulating heat conducting compound and then a cover is permanently secured or staked onto the can. The specific details of the fabrication of the transformer itself are well known in the electrical arts. A number of ends of magnet wire 34 thus extend from the various windings depending on the number of turns of the winding, the number of primaries and secondaries, whether the windings are tapped or not tapped, and so forth. Each of these magnet wires may have an enameled end. The magnet wires are normally made, for example, of copper or aluminum coated with an enameled or varnished insulating material thereon.

Each of these magnet wires 34 has an end attached to a terminal 16 for connection to a lead wire 36. A plurality of these terminals with wires attached are held in predetermined positions by the terminal holder 14.

The terminal holder 14 is formed of electrically insulating material such as a plastic molding. Any suitable material can be used for the terminal holder. For instance, it may be made from a strong polyester material such as a "Nylon 66", a UL-listed material. One example of such material is made by duPont under the tradename "Zytel 101". The purpose of the holder 14 is to hold securely each section of the terminal in a manner to prevent movement and shorting between terminals and between wires of the terminals. The terminal holder 14 has the additional purpose of providing insulation for the terminals from other electrically conductive parts of the electric device in which it is employed.

The holder 14 consists of an open base with a first section or plate such as a relatively thick wall 40. Straight-sided cavities 42 in slots 44 of the thick wall 40 accept the lead wire connection section 46 of the terminal. Slots 48 in a V-shaped configuration through the opposite or second section or plate, such as a relatively thin wall 50, accept the magnet wire section 54 of the terminal 16. The sides 56 of the V-shaped slots 48 have undercut portions 58 so that the terminals can be retained positively at the bottom of the slots.

The plurality of slots in the thick wall are oriented with a given correspondence to the plurality of slots in the thin wall. This facilitates the positioning of the magnet wires and the lead wires for suitable connection. Notches 35 at the corners of the holders can be also provided in order to locate and hold the lead wires which pass from end to end of the device.

The central portion 64 of the holder 14 accommodates that central section 66 or part of the terminal electrically connecting the lead wire connection section 46 and magnet wire sections 54. This central section of the holder also provides a means of strain relief for the wires and constitutes a place to receive any impregnation material which may be displaced from the lead wire guide slots 44 during connection of the lead wire.

The thinner wall 50 of the holder is extended below as extension 68 to form the means of attaching the holder to the lamination clamp. In the illustrative embodiment shown, the method of attachment utilizes the flexibility of the plastic of the holder to provide a snap-on assembly by ears 70 to lugs formed on the lamination clamp. Partial ribs 71 are formed integral with the extension 64 on the underside of the holder to be engaged in slots (not shown) in the lamination clamp in such a manner that the holder may not be displaced sideways or away from the lamination clamp without the installer deliberately removing them from the housing. The holder 14 is, thereby, able to withstand adverse forces which may be encountered during manufacturing operations and subsequent mechanical forces which may be imposed on the lead wires or the system when in service. The support ledge 75 butts against the coil end to prevent the magnet wires contacting the laminations below.

Each metal terminal 16 is comprised of two separate end sections 46 and 54 which are interconnected through an integral central section 66. One end section or first section 46 is upturned at an appropriate angle, such as approximately 90° degrees as shown, and has a suitable connector thereat such as an insulation displacement connector 74 for attaching the lead wires thereto. The other or second section 54 is for attaching the magnet wire 34 thereto. The second section is the barrel section and can have very sharp serrations 76 so that when crimped properly, the serrations cut through the insulation of varnish or enamel on the magnet wires and make a hermetically-sealed connection. A proper connection constitutes not only electrical continuity but also maintains the electrical characteristics of the connection within allowable electrical resistance levels.

Those familiar with the practice of connecting wires by crimping will be aware of the narrowness of the range of wire cross-sectional areas which can be properly connected by a specific size of connection. They will also be aware that the narrowness of the range usually renders it impractical to use the same size crimp terminal for the connection to either one piece or two pieces of magnet wire of the same cross-sectional area. They will yet be further aware that this is a frequently required connection parameter in the manufacture of inductive devices.

To extend the useful size range of the terminal, the magnet wire section can be divided into two barrel or crimping sections 80 and 82, each of a different size. The size of each section may be varied to suit the wire gage sizes for each specific application. The larger section 82 which is adjacent to the interconnecting central section 66 has its length extended toward the interconnecting central section 66. This extension section 84 snaps into the undercut portion 58 in the V-shaped slot of the housing to insure that the terminal stays in the bottom of the V-slot and is resistant to rotation during crimping.

The smaller section 80 has an T-shaped hook 86 at its outboard end to hold the magnet wires in position during the crimping of the terminal. It may be cut off when the excess of magnet wire is removed.

When the smaller section 80 of the terminal is used, the larger section 82 is not crimped at all. When the larger section 84 is used, back sections of the terminal may be crimped to the dimensions of the larger sections. This is for convenience of the crimp tool manufacturer and the setting of the toolings.

The lead wire connection section 46 is bent up at about 90 degrees, in this embodiment, with respect to the magnet wire section as shown. Barbs 88 in the edges grip the cavities 42 in the U-shaped slots 44 of the holder 44 for positive retention of the terminal. The straight-sided cavities 91 have a reduced width area 90 toward the bottom of the cavities 91 so as to accommodate two different wire sizes. The corners 92 at the open end of the slot include a square-cut section for certain displacement of the lead wire insulation. The slots in the terminal holder position the lead wires with sufficient accuracy to render flaring of the terminal slot unnecessary.

As the lead wire is forced into the terminal slot, the sharp corners first displace the insulation on the wire. As the terminal and conductor of the lead wire meet, the terminal slot springs open until the stress springing the slot equals the stress required to gouge grooves in the conductor. As this equilibrium condition continues, the lead wire moves into the slot with the combined actions of the insulation being displaced, the conductor being gouged. In addition, any residue, impregnation or dipping material on the connector is cleaned therefrom. This provides a tightly-sealed, such as a gas-tight seal, electrical connection between the conductor of the lead wire and lead wire section of the terminal.

After the connection is made between the terminal and the lead wire, the terminal may remain in a strained condition and continues to exert pressure on the conductor to maintain the appropriate electrical connections.

In prior art manufacturing techniques for fabricating electrical assemblies of the type described herein, the terminal member(s) were installed on the electrical device such as a fluorescent lamp transformer. The terminal members had connectors thereon for the attachment of magnet wires and lead wires, the connectors being the crimp-type such as those well known in the prior art having barrels at each end which are crimped around the wire conductors upon installation. The magnet wire was brought out of the windings and attached to one end of the connector by crimping it thereto. The entire assembly was then dipped in or impregnated with a wax-like material or varnish which impregnates and/or coats the assembly. Since the assembly was dipped with the lead wires not yet connected to the connector, the lead wire connector area was also coated with the impregnating material during the dipping process.

Continuing with the prior art technique of manufacture, the lead wires which are used to interconnect the transformer to any suitable electrical circuit means outside the assembly, were then attached to the terminal. As a result of the impregnation step, the barrels of connector to which the lead wires were to be connected would then have to be cleaned of impregnation material so that a good electrical coupling was created between it and the lead wire. The lead wire would then be placed in the lead wire barrel and crimped, but only after the lead end of the lead wire was stripped or cleaned of its insulation material.

Further continuing with the prior art technique of manufacture, the assembly with the lead wires now attached was installed into the can or housing, the ends of the lead wires passed through holes in the can, the can filled with a filler material and the cover placed on the can. Since the lead wires were already installed during the handling of the transformer to place it into the can, there was a risk of subsequent disturbance of the connections of the lead wires and magnet wires resulting in possible degradation or outright disconnection of the lead wires from the terminal. This risk was further heightened by the in-line orientation of the magnet and lead wires on the terminal connector typical in the prior art. In addition, the requirement that the lead wire connections be made before placing the transformer into the can caused the inevitable transfer of impregnation material to the production equipment.

In the manufacturing technique of the present invention, the transformer is inserted into the can before the lead wire connections are made. After the dipping process has been completed, the transformer is placed in the can. The lead wires are then connected to the terminal while the transformer is in the can. This can be done, for instance, in a conventional insertion press wherein the can is supported in the press and an insertion ram is brought down onto the lead wire to force it into the insulation placement connector. In addition, other suitable units used with the transformer, such as the capacitor and thermal protection devices, can be connected thereto while the transformer is in the can.

Because of the configuration of the holder and terminal of the present invention, the lead wires can be placed on the terminal holder and held by the slots in the walls 40 & 50 as the lead wires are connected to the terminal. Since an insulation displacement connector may be utilized for the lead wires, there is no need to clean the connector of impregnation material nor to strip the insulation from the end of the lead wire before it is installed. To complete the process, the ends of the lead wires are then passed through holes in the can, the can filled with filler material and the cover placed on the can. Contrary to the prior manufacturing technique, the lead wires are not disturbed due to placement of the transformer into the can after they are assembled thereto and there is a significantly reduced chance of any loose impregnation material reaching the production machinery in using the technique of manufacture of the present invention.

In accordance with the present invention, where the lead wire connector is an insulation displacement connector, there is relatively little thickness to the U-shaped groove which would trap the impregnation material therein. Furthermore, since the U-shaped groove of the connector makes contact with the lead wire conductor unstripped by the forcing of the wire down into the groove, this action forces the insulation coating of the wire away from its conductive central core. Any impregnation material which might be in the groove is forced out of the way of the conductor to permit a suitable electrical connection between the conductor wire and the terminal.

The arrangement of each lead wire with its associated magnet wire, when held together by a terminal and positioned in the slots of the holder, positions the axes of the connected wires at varying heights with respect to the base of the terminal holder and laterally offset one to another. This creates an "out-of-alignment" orientation for the connected wires of the grouping of wires which facilitates differentiating therebetween and good access for each conductor to its connector in the terminal holder. It also eliminates any disturbance of the magnet wire during lead wire connection.

As can be seen in the drawings, the axis of the lead wire and the axis of the magnet wire each lie in a different horizontal plane from the plane of the center section. Further, each of the wire axes lie in different vertical planes perpendicular to the abovementioned plane of the central section. This arrangement also minimizes the possibility of magnet wire breakage. The location of the magnet wires on the coils is such that the wires align as closely as possible with the slots in the holder.

Several alternatives and modifications to the embodiments of the invention described above can be made. The insulation displacement connector may be used for connecting bare rolled wire, such as that without the extruded plastic insulating cover. The lead wire connection section of the terminal can also be modified to accept more than one wire in any suitable manner or more than one wire size. When the connection arrangement requires that two lead wires be connected together, two adjacent terminals can be joined at the central or interconnection sections of the adjacent terminals. This may be achieved as a function of the terminal insertion equipment which would cut terminals from a reel of terminals.

In addition, the holders may be fabricated longer or shorter and with a greater or lesser number of terminal holding slots. The size and shape of the holder may depend on the configuration of the particular application. Further, in every application there is not always a need for each and every slot of the holder to be utilized in supporting a terminal. A selected slot or slots may be left void of a terminal and wires.

Further, any suitable type of connectors can be used in either the first or second sections of the terminal while maintaining each section out of alignment as described above. The connectors can be upturned, downturned, or oriented in any desired way relative to the central section of the terminal and still maintain their out of alignment location. It may be necessary to make modifications to the exact configuration of the slots and the first and second sections of the holder, however, to accommodate the exact configuration of the conductors.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A terminal for electrical connecting wires, comprising a terminal fabricated of electrically conductive material having a planar central section located in a first plane and having formed at a first end an upturned portion being provided therein with a first connector means, said central section having formed at a second end a second connector means, said first connector means and said second conductor means being constructed to hold wires in parallel relationship with respect to one another, with the wires in different parallel planes with respect to a second plane parallel to said first plane, and with the wires in different parallel planes from a plane perpendicular to said first plane.

2. The terminal as set forth in claim 1 wherein said first connector means is a slot constituting an insulation displacement connector.

3. The terminal as set forth in claim 2 wherein said slot terminates in a second slot smaller than the first mentioned slot, for the reception of a wire of one of a plurality of sizes.

4. The terminal as set forth in claim 1 wherein said second connector means is a crimp-forming member constituting a barrel-type connector.

5. The terminal as set forth in claim 4 wherein said second connector means includes a plurality of barrel-type connectors aligned for the reception of wires of a plurality of sizes.

6. An electrical connector system comprising a terminal for electrically connecting wires, said terminal being formed of electrically conductive material and having formed at one end an upturned portion and being provided therein with an insulation displacement connector means, said terminal having formed at another end thereof a barrel-type connector means, each of said connector means being adapted to receive a wire, said system further comprising an electrically insulating means to support a plurality of terminals in such manner that the axes of the received wires are essentially parallel to each other and out-of-alignment.

7. The system as set forth in claim 6 wherein said insulation displacement connector means is formed as a downwardly extending slot for the reception of a lead wire.

8. The system as set forth in claim 7 wherein said slot terminates in an additional but smaller slot for the reception of a lead wire smaller than the first mentioned lead wire.

9. The system as set forth in claim 6 wherein said barrel connector means includes a first and second crimp-type connector axially aligned and of different sizes for the reception of a wire of one of a plurality of sizes.

10. The system as set forth in claim 7 further including serrations on said crimp-type connectors to enhance the electrical connection to magnetic wire.

11. A system for electrical connecting wires, said system including a holder and a plurality of electrical terminals comprising:

said holder being fabricated of electrically insulating material and including a first plate having a plurality of first slots for receiving first portions of said terminals and a second plate also having a plurality of second slots for receiving said portions of said terminals, and said terminals each being fabricated of electrically conductive material and including a first portion with an insulation displacement connector formed therein, said terminals each also having a second portion with a crimp connector thereon, said terminals each also having an intermediate portion electrically connecting said first and second portions, said insulation displacement connector adapted to receive lead wires and said crimp connector adapted to receive a magnetic wires.

12. The system as set forth in claim 11 wherein lead wires received by said insulating displacement connector are contained in a plane above the plane containing the magnet wires.

13. The system as set forth in claim 11 wherein the lead wire and magnet wire received by each terminal are supported in said holder laterally displaced from each other.

14. The system as set forth in claim 11 wherein said first slots are provided with straight-sided cavities on their interior edges for the reception of first portions of said terminals.

15. The system as set forth in claim 11 wherein said second slots are provided with undercut portions for the reception of the second portions of said terminals.

16. A system for electrically connecting wires attached to an electrical device to lead wires comprising:

electrically conducting terminal means having a central station with at least one lead wire connecting means at one end thereof and at least one device wire connecting means at another end thereof, the connector means at each end thereof being out of alignment relative to one another so that wires connected thereto are also out of alignment relative to one another;

electrically insulating terminal holder means adapted to retain the terminal means therein, the holder means having a first plate means for holding the lead wire connector means and a second adjacent plate means side for the device wire connector means; and, means for mounting the holder means relative to the electrical device so that the device wire can enter the holder means on its first plate means side and is electrically connectable to the device wire connecting means and the lead wire can enter the holder means on its second plate means side and is electrically connectable to the lead wire connecting means, the first plate means having a slot means to enable the device wire to pass therethrough and the second plate means having a slot means to enable the lead wire to pass therethrough, whereby the device wire and lead wire are able to be maintained out of alignment as they pass through the holder means to their respective connector means providing easy access to the connector means for installation of the wires.

17. The system as set forth in claim 16 wherein the holder means is mounted on the electrical device.

18. The system as set forth in claim 16 wherein the lead wire connecting means is an insulation displacement connector having a slot means into which the lead wire conductor can be inserted.

19. The system as set forth in claim 18 wherein the lead wire connector means is oriented approximately perpendicularly to the central section of the terminal means.

20. A method of manufacturing electrical device assemblies wherein the assemblies include an electrical device having at least one terminal connector of a predetermined shape which is adapted to receive lead wires for electrically interconnecting the electrical device to an electrical circuit means outside the assembly and a housing which holds the electrical device comprising:

(a) first installing the electrical device into the housing and (b) then interconnecting the lead wire to the terminal connector while the device is in the housing without further reshaping of the terminal connector whereby the lead wire interconnection is not disturbed relative to the terminal connector after interconnection therewith due to the installation of the electrical device into the housing and (c) then filling the housing with a filler material.

21. The method as set forth in claim 20 followed by the step of placing a cover in the housing.

22. The method as set forth in claim 20 preceded by the step of passing the ends of the lead wires through holes in the housing.

23. A method of manufacturing electrical device assemblies wherein the assemblies include an electrical device having at least one terminal connector of a predetermined shape which is adapted to receive lead wires for electrically interconnecting the electrical device to an electrical circuit means outside the assembly and a housing which holds the electrical device comprising:

(a) dipping the electrical device and terminal connector into a material that impregnates and coats the assembly, (b) then installing the electrical device into the housing and (c) then interconnecting the lead wire to the terminal connector while the device is in the housing without further reshaping of the terminal connector whereby the lead wire interconnection is not disturbed relative to the terminal connector after interconnection therewith due to the installation of the electrical device into the housing, the terminal connector to which the lead wires are connected being of the insulation displacement type of connector whereby the lead wire makes a good electrical connection with the terminal connector without the necessity of cleaning the connector to remove the dipping material before interconnecting the lead wire thereto.

24. A method of manufacturing electrical device assemblies wherein the assemblies include an electrical device having at least one terminal connector of a predetermined shape which is adapted to receive lead wires for electrically interconnecting the electrical device to an electrical circuit means outside the assembly, the terminal connector being located on a holder having a plate means thereon with a slot therein aligned with the terminal connector for holding the lead wire adjacent the terminal connector before installation of the lead wire therein, and a housing which holds the electrical device comprising:

(a) first installing the electrical device into the housing, (b) placing the lead wire in the slot, and (c) then interconnecting the lead wire to the terminal connector while the device is in the housing without further reshaping of the terminal connector whereby the lead wire interconnection is not disturbed relative to the terminal connector after interconnection therewith due to the installation of the electrical device into the housing.

* * * * *